United States Patent [19]

Holman

[11] 4,130,170

[45] Dec. 19, 1978

[54] PROBE FOR USE IN GEOLOGICAL SURVEYS

[75] Inventor: Ronald H. C. Holman, Clonee, Ireland

[73] Assignee: Barymin Explorations Limited, Toronto, Canada

[21] Appl. No.: 766,824

[22] Filed: Feb. 8, 1977

[51] Int. Cl.[2] ..... E21B 9/20

[52] U.S. Cl. ..... 175/245; 175/20; 175/58; 175/404

[58] Field of Search ..... 175/20, 58, 245, 403, 175/404, 405, 307, 227, 317; 73/425, 425.2

[56] References Cited

U.S. PATENT DOCUMENTS

| | | | |
|---|---|---|---|
| 368,344 | 8/1887 | Layer | 78/425 |
| 1,207,119 | 12/1916 | Young | 175/404 X |
| 1,867,024 | 7/1932 | Oliver | 175/404 X |
| 1,882,906 | 10/1932 | Renfer | 175/405 X |
| 2,288,210 | 6/1942 | Schlumberger | 175/245 |
| 2,880,969 | 4/1959 | Williams | 175/245 X |
| 3,324,958 | 6/1967 | Clark | 175/405 X |
| 3,360,058 | 12/1967 | Von Ruden | 175/404 X |
| 3,605,920 | 9/1971 | Woodward | 175/245 X |

FOREIGN PATENT DOCUMENTS

| | | | |
|---|---|---|---|
| 319067 | 2/1902 | France | 175/405 |
| 776028 | 5/1957 | United Kingdom | 175/404 |

*Primary Examiner*—Ernest R. Purser
*Assistant Examiner*—Richard E. Favreau
*Attorney, Agent, or Firm*—Sughrue, Rothwell, Mion, Zinn and Macpeak

[57] ABSTRACT

A probe construction for use in geological surveys designed to extract earth samples at a predetermined depth. The probe consists essentially of an elongated metal body with a hollow core, the longitudinal axis of the core being at approximately 5° to the longitudinal axis of the metal body. A side outlet is provided along substantially the length of the metal body. The probe is adapted for engagement with the drive rod of a hammer mill or the like machine.

9 Claims, 4 Drawing Figures

PROBE FOR USE IN GEOLOGICAL SURVEYS

This invention relates to a probe for use in geological explorations and in particular to a probe adapted to extract earth samples at a predetermined desired depth. The probe of the present invention is particularly adapted for use with a powered hammer mill of conventional construction, powered hammer mills being commonly used in geological surveys.

It is well known when carrying out a geological survey to make bore holes using a conventional petrol powered hammer mill and a plurality of interconnectable rod members — the procedure being to use the hammer mill to drive the rods into the ground, the second rod being screw connected to the first rod and the third rod being screw connected to the second rod etc., until the desired depth of bore hole has been made. The rod members may then be extracted and a probe member attached to the bottom of the first rod, placed into the bore hole, and pushed to the end of the bore hole where a sample of earth may be taken. Conventional type probes employ either a retractable core member or a rotatable core to lift up the earth sample at the bottom of the bore hole. It will be appreciated, however, that since the rods used are usually not greater than one inch diameter the construction of the known probe members is often quite sophisticated and complex, in order to overcome problems resultant upon the employment of moving parts, to give the probe member sufficient strength within a one inch diameter. Due to the sophistication and complexity of construction, the known probe members are of course, quite expensive.

It is an object of the present invention to overcome this difficulty by providing a probe member of simple and robust construction. Accordingly, the present invention provides a probe for extracting samples from below the surface of the earth, the said probe comprising an elongated body having a hollow core, the elongated body and the hollow core having respective longitudinal axis which are inclined at a small angle to one another such that the hollow core extends from one end of the body to one side thereof, the said probe further comprising means at the other end of the body adapted for engagement with the drive rod of a powered hammer mill or the like.

The invention will be understood from the following description of an embodiment thereof given by way of example only with reference to the accompanying drawings in which.

Figure 2:
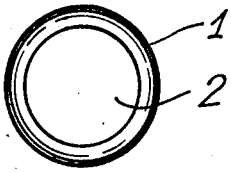
FIG. 2 is a bottom view of the probe.
Figure 1:
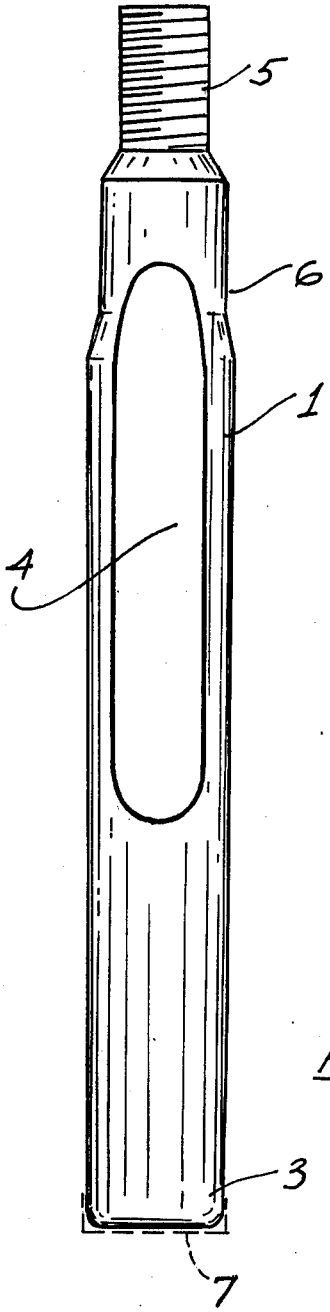
FIG. 1 is a front view of the probe.
Figure 4:
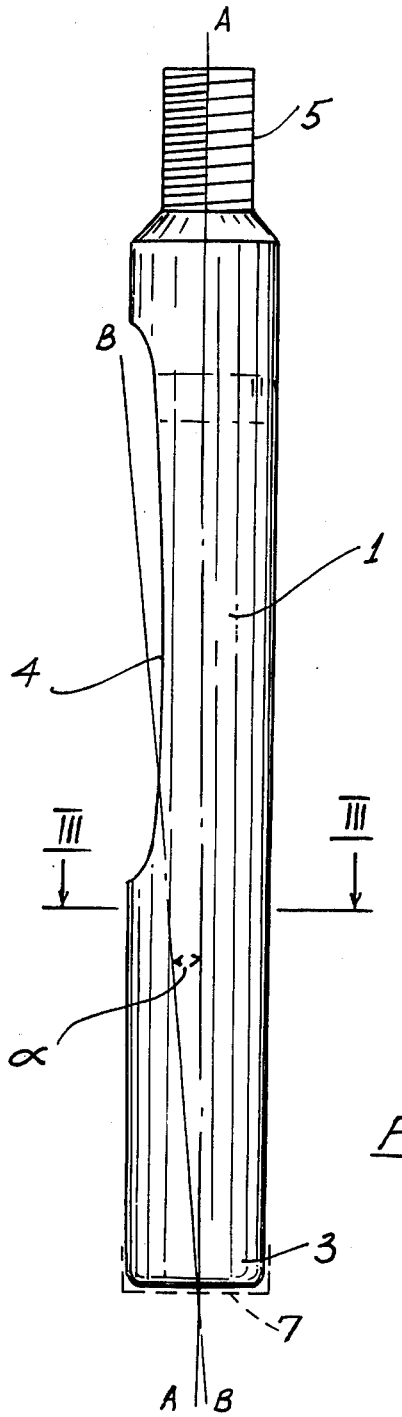
FIG. 4 is a side view of the probe which indicates the central longitudinal axis A — A of the probe body and the central longitudinal axis of the hollow core of the probe body.
Figure 3:
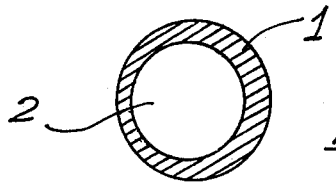
FIG. 3 is a transverse cross-sectional view of the probe taken on the line 3 — 3 of FIG. 1.

Referring to the drawings the probe comprises an elongated body 1 of generally cylindrical form having a hollow core 2 which extends from the end 3 of the body along substantially the length thereof to provide a side outlet 4. The longitudinal axis B — B of the hollow core is offset from the longitudinal axis A — A of the body by a small angle $\alpha$. Preferably $\alpha$ should be approximately 5° and should not exceed an angle $\alpha$ approximately of 10°.

The end 5 of the body 1 is suitably screw threaded and flanged at 6 to facilitate the engagement of that end of the probe with the free end of a drive rod of conventional construction which is used with conventional petrol powered hammer mills employed in geological exploration work.

In operation the probe is secured to an end of a drive rod which is in turn connected to a hammer mill. The probe and rod are driven into the ground by the hammer mill in a substantially non-rotary manner, successive drive rods being added until the probe is at the desired depth. During the drive action upon the rod as it is progressively forced down through the earth any soil, gravel etc., which enters into the core 2 is forced upward and out through the side outlet 4. When the probe has been driven to the correct depth the soil in the probe at that time is in fact the desired sample and the probe can then be removed from the bore hole and the sample removed from the probe. An alternative procedure is in fact to prepare the bore hole in a conventional manner using the drive rods and the hammer mill and at that stage to send down the probe and merely actuate the hammer mill momentarily to force the probe into the earth at the bottom of the bore to extract the desired sample. This procedure has the advantage that it causes little wear on the probe and of course, mitigates against any problem of obstruction to earth flow through the core 2 as the probe is forced through the earth as described earlier.

It is envisaged that in certain circumstances when a probe according to the present invention is being used and inserted into a previously prepared bore hole a plastic cover 7 (shown schematically in broken lines) may be placed over the open end 3 of the body. When the probe has reached the bottom of the bore hole the action of the hammer mill will cause the end 3 of the body 1 to rupture the protective plastic cover 7 and take the sample of earth as described previously. The plastic cover 7 in addition to serving as a protective cover for the probe also ensures that during its travel down the bore hole no earth enters into the core 2. The use of the plastic cover 7 is however recognised as a refinement and is not strictly necessary for the use of the present invention.

In practice the probe according to the present invention is preferably made of nickle crome steel which is oil tempered. In addition, the overall diameter of the probe body should not exceed approximately one inch, since the greater the diameter of the probe the greater the power requirement to create the bore hole.

The probe of the present invention has been described above as a probe predominantly for use in geological surveys. It is to be clearly understood that the probe of the present invention may also be readily utilised for example in taking samples from waste dumps, in environmental and conservation surveys or in land use surveys for accessing the land potential for agricultural or forestry uses. It will also be understood that the size of the probe may be varied to suit the use for which each particular probe is primarily intended. Large size probes may for example be used with a heavy percussive rig in geological surveys.

I claim:

1. A probe for extracting samples from below the surface of the earth, said probe comprising an elongated body having a smooth bottom annular surface, a hollow core in the elongated body, the elongated body and the hollow core having respective longitudinal axes which are inclined at a small angle to one another such that the hollow core extends from one end of the body to one side thereof, the said probe further comprising means at the other end of the body adapted for engagement with a drive rod of a powered hammer mill.

2. A probe according to claim 1, in which the body is generally cylindrical.

3. A probe according to claim 2, in which the diameter of the body is approximately 1 inch or less.

4. A probe according to claim 3, in which the small angle is approximately 10° or less.

5. A probe according to claim 4, in which the small angle is approximately 5°.

6. A probe according to claim 1, further comprising a protective cover over the said one end of the body, the said cover being of a material which can be ruptured by force applied by the body.

7. A probe according to claim 6, in which the cover is of plastics material.

8. A probe according to claim 1, in which the small angle is approximately 10° or less.

9. A probe according to claim 8, in which the small angle is approximately 5°.

* * * * *